US010561919B1

(12) United States Patent
Huff

(10) Patent No.: US 10,561,919 B1
(45) Date of Patent: Feb. 18, 2020

(54) MOBILE TRAINER SLED WITH SHIFTING SECTION STRIKING PAD

(71) Applicant: Avery Vaughn Huff, Missouri City, TX (US)

(72) Inventor: Avery Vaughn Huff, Missouri City, TX (US)

( * ) Notice: Subject to any disclaimer, the term of this patent is extended or adjusted under 35 U.S.C. 154(b) by 0 days.

(21) Appl. No.: 15/859,877

(22) Filed: Jan. 2, 2018

Related U.S. Application Data

(60) Provisional application No. 62/441,275, filed on Dec. 31, 2016.

(51) Int. Cl.
*A63B 69/34* (2006.01)

(52) U.S. Cl.
CPC ..... *A63B 69/345* (2013.01); *A63B 2210/50* (2013.01); *A63B 2225/093* (2013.01); *A63B 2243/007* (2013.01)

(58) Field of Classification Search
CPC ..... A63B 69/345; A63B 2243/007; A63B 2210/50; A63B 2225/093
See application file for complete search history.

(56) References Cited

U.S. PATENT DOCUMENTS

| | | | | |
|---|---|---|---|---|
| 2,526,217 | A | 10/1950 | Gilman | |
| 3,062,547 | A * | 11/1962 | Kopp | A63B 69/345 434/251 |
| 3,396,969 | A | 8/1968 | Rosenfeld | |
| 3,587,319 | A * | 6/1971 | Andrews | A63B 21/0083 482/112 |
| 4,087,089 | A | 5/1978 | Forrest | |
| 6,988,965 | B2 | 1/2006 | Krause | |
| 7,147,579 | B2 * | 12/2006 | Forrest | A63B 69/345 473/441 |
| 7,470,224 | B1 * | 12/2008 | Everett | A63B 21/04 482/121 |
| 7,527,568 | B2 | 5/2009 | Joseph | |
| 9,192,803 | B2 * | 11/2015 | Cayo | A63B 21/0618 |
| 2013/0184104 | A1 * | 7/2013 | Gilman | A63B 69/345 473/445 |

* cited by examiner

*Primary Examiner* — Jeffrey S Vanderveen
(74) *Attorney, Agent, or Firm* — Karen B. Tripp

(57) ABSTRACT

A portable athletic trainer sled having a strike pad capable of movements in multiple planes for teaching and practicing footwork, striking points, head placement and directional maneuvering techniques for contact sports, minimizing risk of concussion. The sled is light in weight, adjustable, and easily assembled and disassembled.

16 Claims, 11 Drawing Sheets

MOBILE TRAINER SLED WITH SHIFTING SECTION STRIKING PAD

RELATED APPLICATION

This non-provisional application claims priority from U.S. Provisional Patent Application No. 62/441,275, filed Dec. 31, 2016.

FIELD

The present invention relates generally to sport training apparatuses, and particularly to training equipment for contact type sports. More particularly, the present invention relates to equipment such as sporting type sleds, for use in teaching and practicing proper technique for physical contact with an opposing player for effective and safe play. Most particularly, the present invention relates to such sleds that enable players to physically practice to enhance their skills without making contact with a live individual, focusing on effective play techniques that avoid head injury during contact play.

BACKGROUND

Contact sports, including, but not limited to football, have historically relied upon the use of both head and helmet as a tool in stopping an opponent. In addition to arms, legs and feet, the head has been used as a necessary appendage to be implemented in effectively slowing or stopping an opposing player (as depicted in the "head first" approach of U.S. Pat. No. 7,527,568). Yet, as several key studies have concluded, concussions and sub-concussive trauma have led to both short and long-term impacts affecting the short term, and overall long-term, health of players both on and off the field. While rule changes (with an increasing emphasis on player safety) have been implemented over the past several years, concussions and resulting traumatic brain injuries (mild traumatic brain injury or MTBI being the most common) continue. Immediate sequalae have long been noted to range from headache, dizziness, vision disturbances to complete loss of consciousness (LOC), yet recent evidence suggests that untoward effects can range from subtle (e.g. cognitive deficiencies, loss of certain brain functions, nausea and vomiting, lack of motor coordination, tinnitus, double vision, and light sensitivity) to more insidious symptoms including pronounced cognitive impairment, sleep disturbances, emotional symptoms, physical manifestations, disinhibitions and other mood and behavior changes to more long-term health related issues including Parkinsonian manifestations and Parkinson's Disease, dementia, Alzheimer's disease, long-term memory loss, psychiatric disorders, depression, and, most poignantly, chronic traumatic inflammation, axonal injury, and encephalopathy (CTE)—a progressive degenerative brain disorder in individuals with a history of repeated head trauma.

Given the above, full contact sports in general, and football in particular, are undergoing a paradigm shift for the health and safety of all of its participants. To this end, a transition from the historic style of tackling (e.g. head first) to a "rugby-style" tackling, those tackling techniques meant to keep players heads away from impact or so called "Heads-Up Football," are being implemented and engrained into current players in an attempt to decrease the overall incidences of head trauma and concussion. In this "modified tackling method," hand placement, leveraging, shoulder tackling (leverage-based shoulder tacking), and foot placement, as opposed to head-first tackling, are emphasized and used in tackling the opponent (e.g. near and around the hip and waist area), properly placing hands on the opponent, maintaining leverage (with helmet across the opponent and lowered shoulder used in displacing the opponent), and "wrapping up" the opponent in an effort to thwart the opponent's forward advancement. Succinctly, players are instructed to "rise" into the ball carrier with their chests, shoulders and arms in an ascending manner, as opposed to leading with their head.

BRIEF DESCRIPTION OF RELEVANT ART

Contact sports, such as football for example, typically involve extensive, agile movements during the sporting event. For effective play, players typically need to learn and practice the techniques and methods associated with such movements. A number of apparatuses and devices have been employed over the years to aid in such practice, early on commonly requiring human training partners for practicing contact-sport movements for stopping, slowing, or reversing the direction of an opponent. See, for example, U.S. Pat. No. 2,526,217, issued to Gilman, and U.S. Pat. No. 3,396,969 issued to Rosenfeld, calling for a live training partner to yield a "shield-like" blocking pad.

Many attempts have been made to provide training devices for practicing contact-sport movements for stopping, slowing, or reversing the direction of an opponent, without requiring an actual live opponent or a training partner for practice. Sporting type "sleds" are a commonly used example.

Sporting type "sleds" typically have a flat type base and an upright structure affixed to the flat type base and a cushion or pads for striking. U.S. Pat. No. 4,087,089, issued to Forrest, and U.S. Pat. No. 6,988,965, issued to Krause, both provide representations that exemplify this "sled" construction and reveal its basic structural design. Functionally, a player can "work their skills" by hitting or striking the strike pad section of the sled with sufficient force to move the sled backwards. The movement simulates contact with an opposing player and moving the opposing player backwards, for practicing a play used in actual game. And, whereas both the '089 and the '965 patents test the players mettle in brute strength and coarse force, neither instructs the player on hand placement and opponent manipulation through leverage that is required in tackling techniques designed to lower the risk of concussion.

The sled invention of U.S. Pat. No. 6,458,051, issued to Moore, shows a training platform that can move backwards in a predefined, preselected track but it is incapable of more advanced movements. Similarly, U.S. Pat. No. 3,997,160, issued to George, discloses a stationary sled and strike pad, in the form of a dummy, that has the ability to move rearwardly and in additional planes of movement including side-to-side and rotationally (i.e. "twisted about a vertical axis") The sleds in these patents, however, is directed only to rearward movement along a pre-defined single-track that defines the rearward movement and allows only stationary positioning.

U.S. Pat. No. 5,385,523, issued to Forrest, details dual movement where the striking pad and moveable sled combination that can be moved backward, the striking pad may be optionally pivoted upwardly and downwardly and secured into a desired, static position through a bracket and pin arrangement that locks the "elongated arm" in place "within the limits defined by use."

U.S. Pat. No. 6,942,585, issued to Krause, provides a fixed-wheel arrangement, with (1) an adjustable-height strike pad, that can be adjustably set upwardly and downwardly, (2) an inward moving strike pad expressing resistance and recoil through a coil spring, upward tilting movement (where the wheel is the fulcrum), and a traditional backward "sled" movement.

Need continues to exist for a mobile, easy-to-use, sport training device that is useful in teaching and improving methods and techniques for sports involving extensive agile movements during the sporting event, such as, for example, tackling and blocking in football, in a way to avoid possible concussions or other head injury.

SUMMARY

The present invention provides a mobile trainer sled that can be assembled and disassembled on-site or at the field for use in teaching and practicing proper hand placement, foot placement, foot maneuvering, leveraged force and "heads up" tackling techniques for contact sports. The mobile trainer sled of the present invention facilitates training on manipulation and engagement of an opposing player in a manner that greatly reduces the likelihood that "head-first" tackling will occur and head trauma will result.

The mobile trainer sled of the present invention has a multi-directional, multi-planar functioning strike pad and a sled base capable of movement in all directions on a horizontal plane. The strike pad can "twist" left or right, fall forward and backward, and collapse down almost flat (left or right) to a near horizontal configuration, while also affording resistance and "push-back" when struck, all while allowing the sled base to be moved backwards. These various movements encourage and even require a user to move his or her feet in a proper position for effective practice of techniques. The movements also promote proper hand placement and maneuvering of an opponent to a desired position or area, all the while avoiding head to head contact.

It is an object of the present invention to create a novel training device that avoids concussive injury.

It is an object of the present invention that allows for a training device with a horizontally movable and multi-directional sled base, a multi-directional, multiplanar moving torso and a moveable head to teach proper "heads up" technique, directional opponent manipulation, and avoidance of head-to-head contact through fluid, intuitive movements.

It is another object of this present invention to create a training device that educates and affords practice to amateur and professional athletes in proper balance, hand positioning, foot placement and directional force placement in an attempt to effectively directionally move an opponent.

It is another object of this present invention to instruct amateur and professional athletes on proper head placement during physical contact with an opponent with an end goal of lessening or avoiding concussive head injury.

It is yet another object of this present invention to provide a training device that is easily assembled and disassembled for storage and transport.

It is yet another object of the present invention to provide a training device that is light weight, collapsible, and easily transported.

Equally, a need exists for a training device that is mobile and capable of uncomplicated manipulation in adjustment, storage, and transportation

BRIEF DESCRIPTION OF THE DRAWINGS

FIG. 1A—a front view; FIG. 1B—a side view; FIG. 1C—a perspective back view; FIG. 1D—a top view; and FIG. 1E—a side view with the strike pad in a turned position.

FIG. 19 being at approximately 180 degrees of rotation for demonstration, FIG. 20 being at approximately 270 degrees of rotations for demonstration, and FIG. 21 being at approximately 340 degrees of rotation, or almost back to the starting point which would be FIG. 16.

DETAILED DESCRIPTION

Figure 1C:
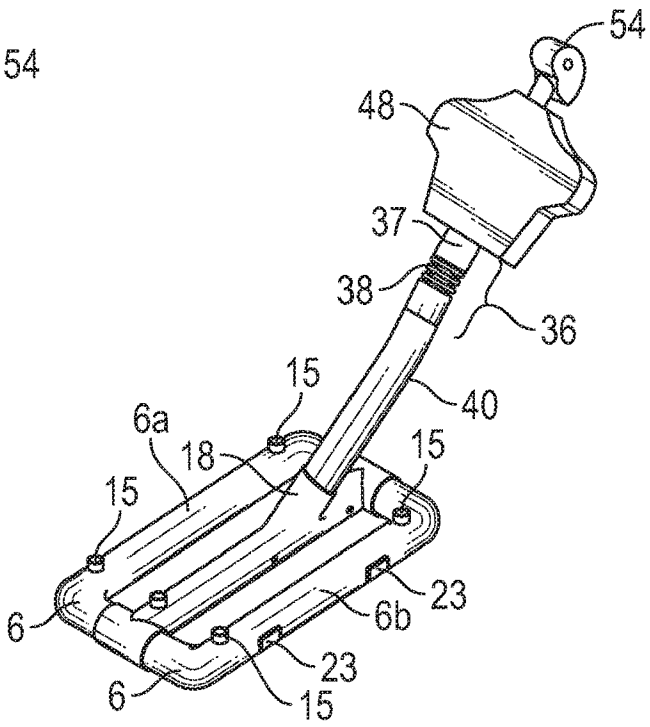
FIGS. 1A-1E show one embodiment of the mobile trainer sled of the invention from five different perspectives, all presented together.
Figure 1B:
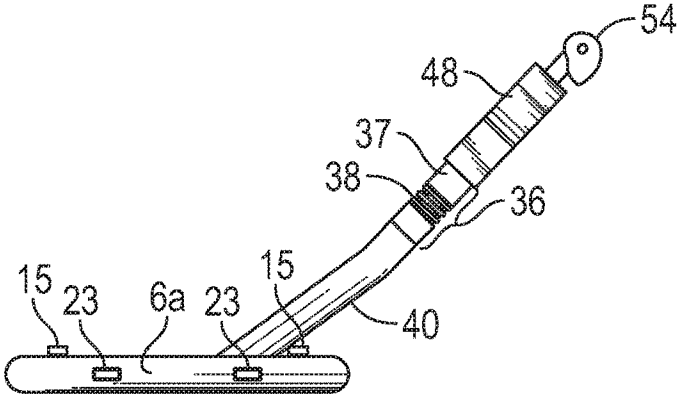
Figure 1E:
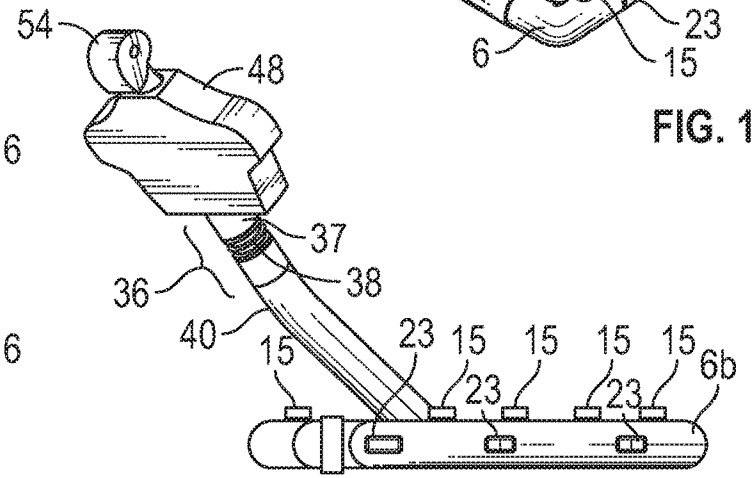
Figure 1A:
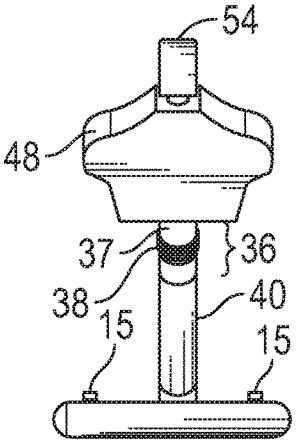
Figure 1D:
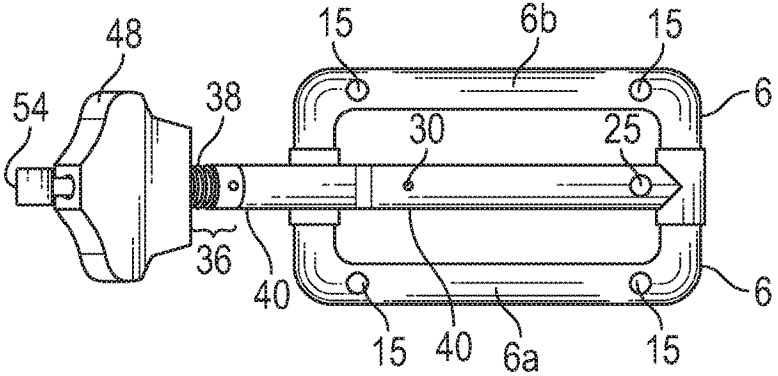

This detailed description is not intended to be exhaustive or to limit the invention to the precise form disclosed, as the invention can be practiced with numerous modifications and alternate configurations. This description is intended to be read in connection with the accompanying drawings, which are to be considered part of the entire written description of this invention. The drawing FIGURES are not necessarily to scale and certain features of the invention may be shown exaggerated in scale or in somewhat schematic form in the interest of clarity and conciseness. The invention is applicable to other embodiments or of being practiced or carried out in various ways, and the invention will be limited only by the claims and the equivalents thereof. Unless defined otherwise, all technical and scientific terms used herein have the same meaning as commonly understood to one of ordinary skill in the art to which this invention belongs. As used herein and in the appended claims, the singular forms "a," "an," and "the" include plural referents unless the context clearly dictates otherwise. All of the phraseology and terminology employed herein is for the purpose of description and should not be regarded as limiting.

This invention provides a portable, contact-sports training apparatus, which may be called a "mobile trainer sled," designed to prepare and guide users in techniques such as blocking and tackling for effective play while avoiding concussions. Because of its portability, an athlete, coach or trainer can readily transport the mobile trainer sled in an automobile and assemble it on a playing or practice field. The invention affords teaching/training and practice on footwork, striking points, head placement and directional maneuvering techniques for contact sports.

In its simplest form, the mobile trainer sled of the invention comprises a base 6, a strike pad 48, and a limb 40 connecting the strike pad to the base. The limb 40 supports the strike pad 48 and has a spring section 36 that affords flexibility to the strike pad 48, that is, that enables the strike pad 48 to twist. The spring is also believed to absorb some of the impact force from the striking of the strike pad and the spring is believed to contribute to an upward motion of the strike pad. A connector 18/19 connecting the limb 40 to the base 6 enables the limb 40 to move or pivot to left or right of center from an upfront (vertical) position to a near laying or laying down (horizontal or near horizontal) position. The head 54 and strike pad 48 of the mobile trainer sled twist left or right and collapse down almost flat or horizontal and left or right. This movement causes the user or trainee to move his or her feet in a directional movement left or right to keep the feet in proper balance and control while pushing the sled backward. The proper technique for hand strike placement and maneuvering an individual to a desired position or area is facilitated as well. The strike pad torso structure allows that area of the mobile trainer sled to be struck with precise punching placement of the handgrip. The head movement of the mobile trainer sled allows the user to avoid head to head contact when striking the mobile trainer sled.

Figure 2:
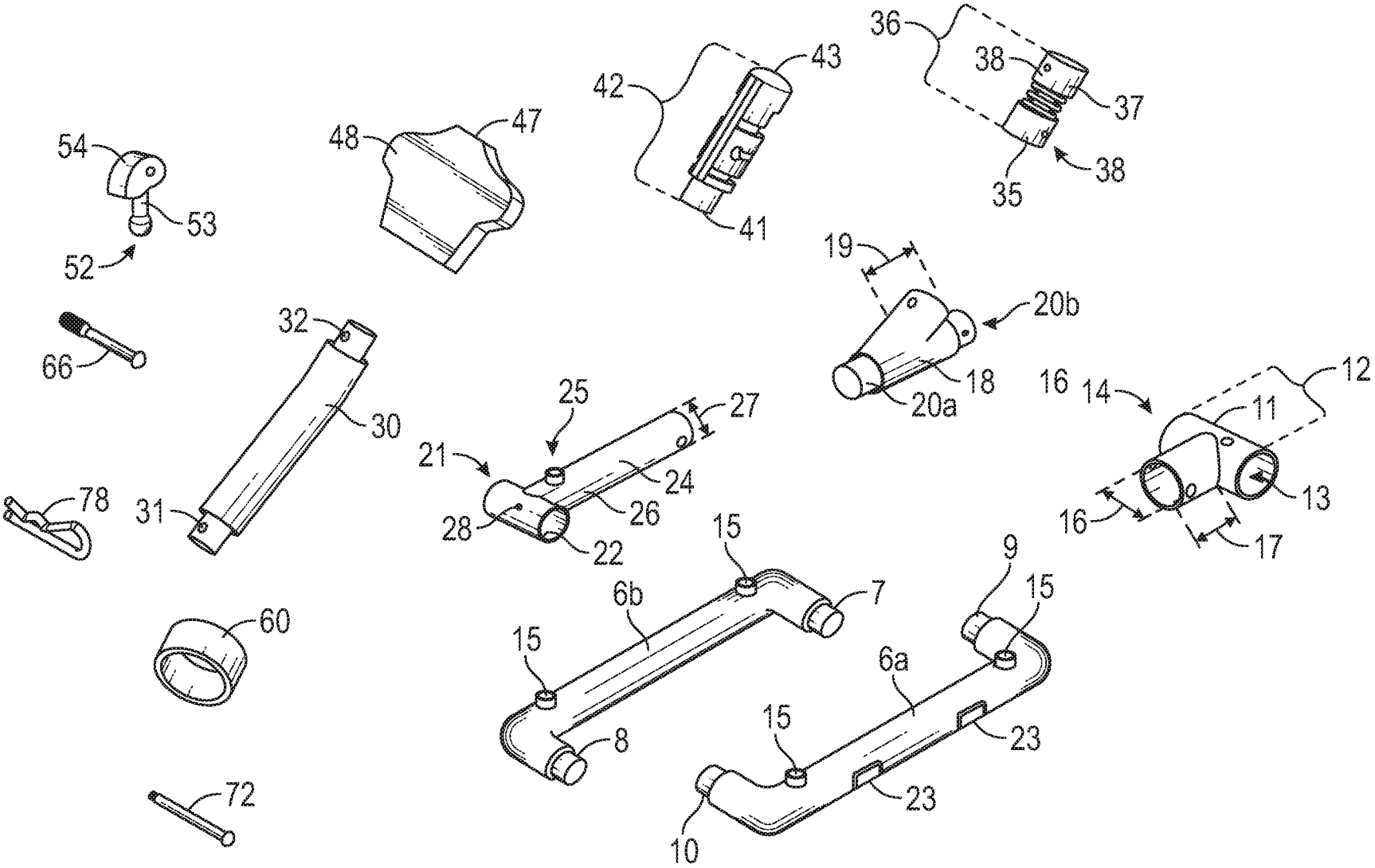
FIG. 2 shows the various parts of the embodiment of the mobile trainer sled of FIGS. 1A-1E disassembled into its various parts.

Referring for illustration to one embodiment of the invention shown in the FIGURES, FIGS. 1A, 1B, 1C, 1D, and 1E ("FIGURES 1A-1E") present a mobile trainer sled of the invention from different perspectives, assembled from the parts for this embodiment shown in FIG. 2. FIGS. 3, 9, 10, 11, 12, and 13 indicate how the parts are assembled to put this embodiment of the mobile trainer sled together. For example, generally, in one embodiment, the inner base is connected first, the outer base is connected to the inner base second, the limb, particularly the lower limb and upper or extended limb, are connected to the inner base third, and the strike pad and head attachment are connected to the upper extended limb last. These parts can be assembled together in different order so long as they are ultimately connected as shown in FIGS. 1A-1E.

Referring to FIGS. 1A-1E, 2, 3, 9, 10, 11, 12, and 13, an outer base 6 is comprised of a pair of elongated "U"-shaped bars, cylinders, or tubes, 6*a* and 6*b*, having sufficient weight, diameter and length to provide stability and support to the mobile trainer sled. In one embodiment, the tubes 6*a* and 6*b* are hollow or have at least one cavity (not shown) for receiving sand or water to add weight to base 6 to enhance the stability and support base 6 can provide to the mobile trainer sled. In an alternative embodiment, the tubes 6*a* and 6*b* are solid. Tubes 6*a* and 6*b* are connected together via a "T"-shaped bar, cylinder, or tube 12 positioned at the front (side 11) of the mobile trainer sled and an opposing "T"-shaped bar, cylinder, or tube 24 positioned at the rear of the mobile trainer sled. In the embodiment shown in the FIGURES, the ends of the "U"-shaped tubes that connect to the "T"-shaped tubes 12 and 24 are male connectors 7, 9, 8, and 10 and the ends of the "T"-shaped tubes 14, 13, 21, and 22 are female connectors. However, in another embodiment, the opposite design is used, where the "U"-shaped tubes have female connectors and the "T"-shaped tubes have male connectors. Pins 72 such as lock pins for example, or pin screws or screw pins 66 for another example, and/or clamps 78 can be used to further secure the connections. In still another embodiment, the "U"-shaped tubes and the "T"-shaped tubes are extruded, carved, cut or welded or otherwise formed of one piece. In still another alternative embodiment, base 6 is comprised of a solid platform instead of bars, tubes or cylinders.

Figure 3:
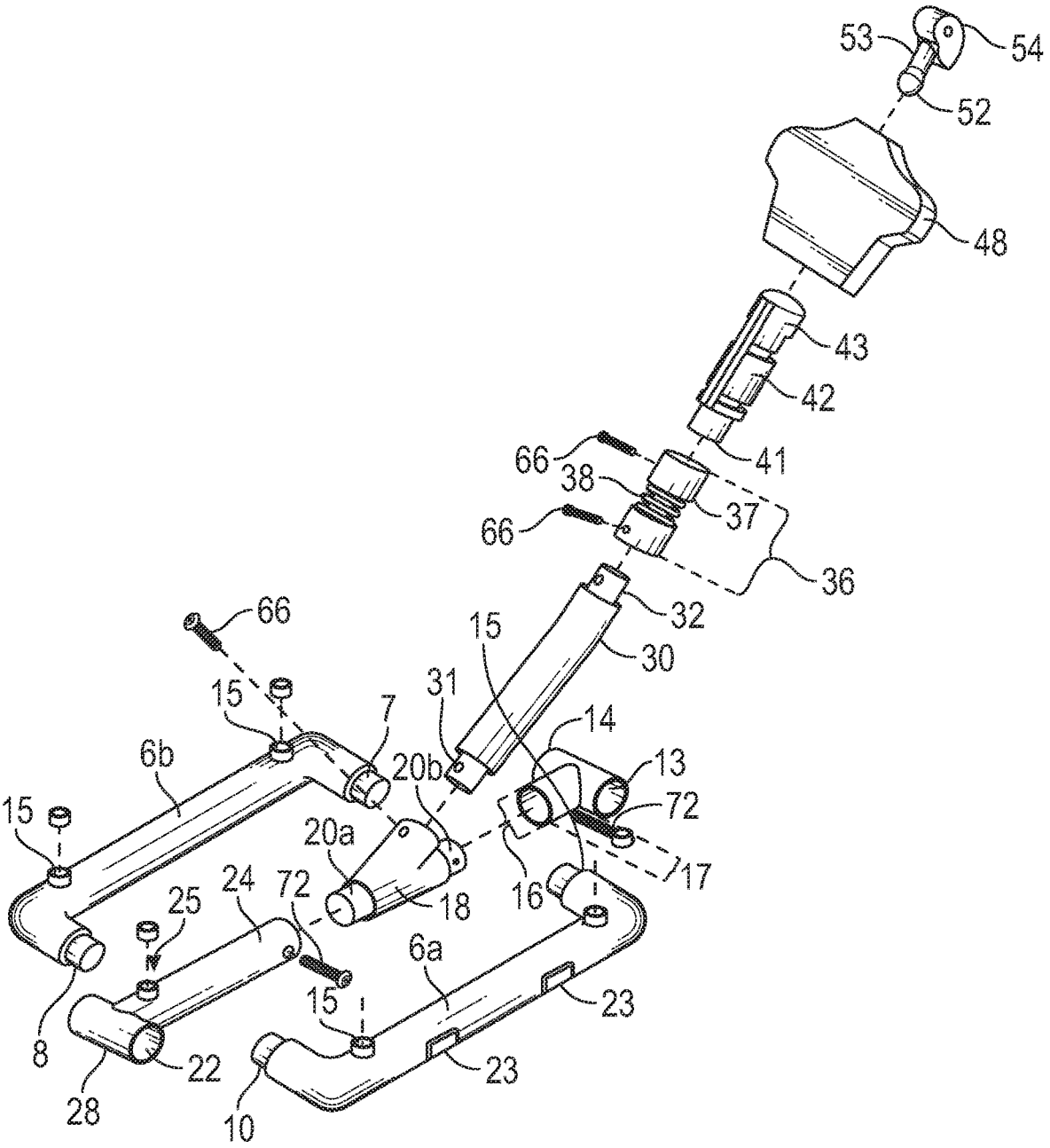
FIG. 3 shows an exploded view of the embodiment of the mobile trainer sled of FIG. 1C.
Figure 25:
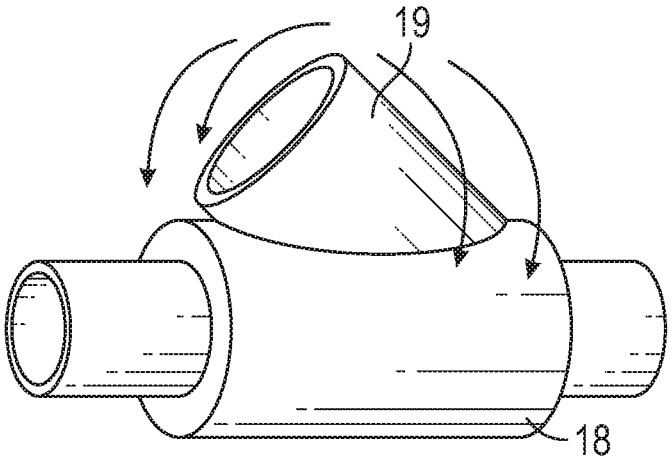
FIG. 25 shows an enlarged side perspective view of the central base connector and limb attacher on the embodiment of the mobile trainer sled of FIG. 1C, illustrating its ability to pivot sideways in two directions when not stopped or held by a pin.
Figure 26:
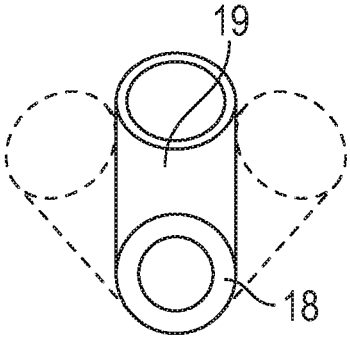
FIG. 26 shows an enlarged front view of the central base connector and limb attacher of FIG. 1C, illustrating its ability to pivot sideways in two directions when not stopped or held by a pin, as also shown in FIG. 25.
Figure 27:
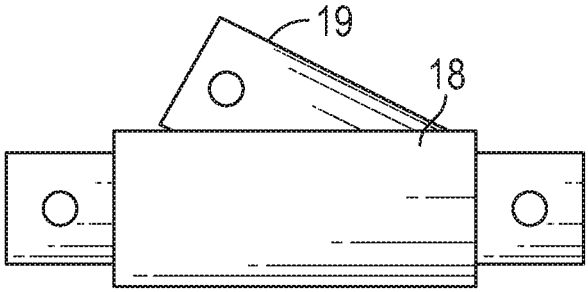
FIG. 27 shows a side view of the central base connector and limb attacher on the embodiment of the mobile trainer sled of FIG. 1C, enlarged as in FIG. 25.

In the embodiment of the mobile trainer sled shown in the FIGS. 1A-1E, 2, 3, 9, 10, 11, 12, and 13, "T"-shaped tubes 12 and 24 have a third connector bar, cylinder, or tube 18 between them connecting the "T"-shaped tubes 12 and 24 together and also connecting to lower limb 30 via a bar, cylinder or tube 19 extending outwardly and upwardly and forwardly (toward side 11) at an acute angle (about 15 degrees to about 75 degrees) from tube 18. In this embodiment, tube 18 and 19, as shown larger in FIGS. 25, 26 and 27, have the ability to pivot as illustrated in FIGS. 25 and 26. A pin 66, however, as shown in FIG. 3, can be used to restrain or stop the pivoting if desired.

Figure 7:
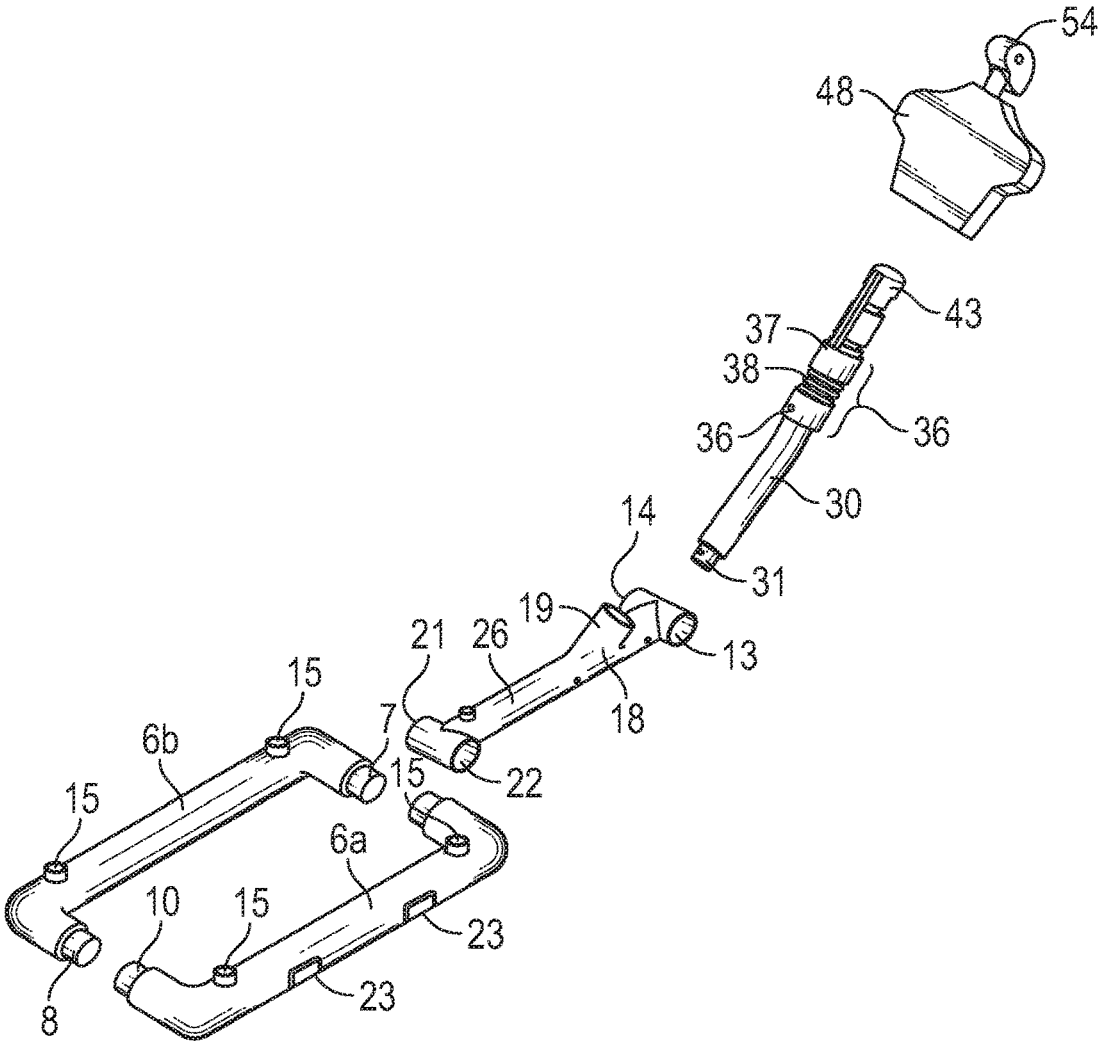
FIG. 7 shows a partially exploded view of the embodiment of the mobile trainer sled of FIG. 1C.

In alternative embodiments, the "T"-shaped tubes 12 or 24 could connect directly together and "T"-shaped tube 12 or "T"-shaped tube 24 could have bar, cylinder or tube 19 extending outwardly and upwardly and forwardly (toward side 11) at an acute angle (about 15 degrees to about 75 degrees) from "T"-shaped tube 12 or "T"-shaped tube 24 rather than from an additional tube like tube 18. In another embodiment, the "T"-shaped tubes 12 and 24 could be formed instead as one tube 26 with "T"-shaped ends as shown in FIG. 7 and tube 26 could have bar, cylinder or tube 19 extending outwardly and upwardly and forwardly (toward side 11) at an acute angle (about 15 degrees to about 75 degrees) from tube 26 rather than from an additional tube like tube 18. In still another alternative embodiment, bar, cylinder or tube 19 extends outwardly and upwardly and forwardly (toward side 11) for connecting to lower limb 30 at an acute angle (in one embodiment about 15 degrees to about 75 degrees) directly from base 6 comprised of a solid platform.

Figure 6:
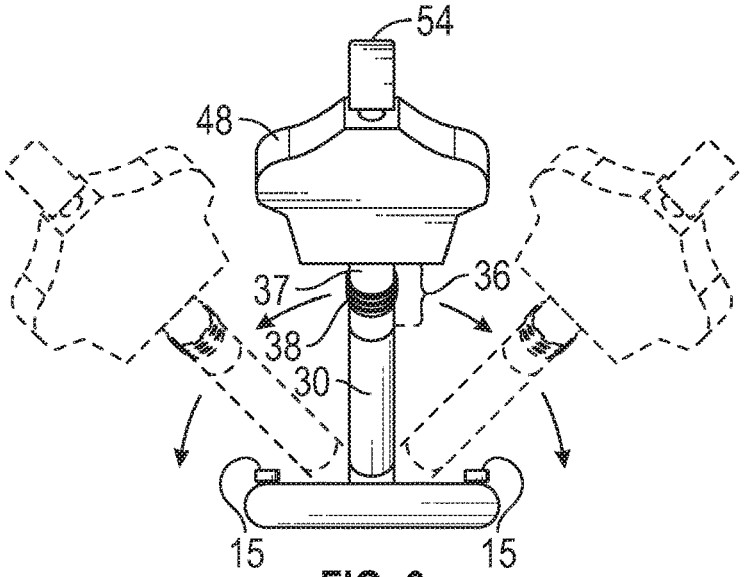
FIG. 6 shows a top front perspective view of the embodiment of the mobile trainer sled of FIG. 1A illustrating the ability of the head-strike pad-extended or upper limb-spring-limb or lower limb portion of the embodiment of the mobile trainer sled of FIG. 1A to move to the left and right or sideways from center.

In the embodiment of the mobile trainer sled shown in the FIGURES, the ends 16 and 27 of the "T"-shaped tubes 12 and 24 respectively are designed as female connectors and corresponding tube 18's connecting ends 20*a* (for end 27 of tube 24) and 20*b* (for end 16 of tube 12) are male connectors. However, in another embodiment, the opposite design is used, where tube 18 has all female connecting ends and the "T"-shaped tubes have male connectors. Pins 72 such as lock pins for example, or pin screws or screw pins 66 for another example, or clamps 78 can be used to further secure the connections, but such pins or clamps should not be used when it is desired for tube 18 to pivot and thereby afford the lower limb 30 to move from side to side in a downwardly direction as shown in FIG. 6, as such pins and clamps will inhibit that movement. Tube 19 preferably has a female connecting end for receiving lower limb 30 as shown in the FIGURES, whether tube 19 extends from tube 18 as shown in the FIGURES or from tube 12 or tube 24 or directly from base 6 as in alternative embodiments not shown.

In the embodiment of the mobile trainer sled shown in the FIGURES, base 6 comprises at least one hole 15 with a cap 60 for filling at least one interior cavity (not shown) within the base 6 with sand, water, or other weighty material such as for non-limiting example, cross-linked polyacrylate polymer, for adding weight to the base 6. In FIGS. 1A-1E, 2, 3, 9, 10, 11, 12, and 13, the "U"-shaped tubes 6*a* and 6*b* each contain on their top side, for example, two holes 15, which do not extend through the bottom side of the tubes 6*a* and 6*b* and have caps 60 for closing and preferably sealing the holes 15. Optionally, base 6 and particularly in the FIGURES, tubes 6*a* and 6*b*, can have handles 23 that can take the form of indentions or protruding handles, to aid in handling, positioning and carrying the mobile trainer sled, as well as assembling and disassembling it.

As stated above, in the embodiments shown in the FIGURES, lower limb 30 connects to central or middle support member 29 (which consists of tubes 12, 18, 19, and 24 in FIGS. 1A-1E, 2, 3, 10, 11, 12, and 13 and consists of tube 26 with "T" shaped ends in FIG. 7) of base 6. In an alternative embodiments not shown, lower limb 30 connects directly to tube 19 and base 6, or even just directly to base 6. Preferably, the end of lower limb 30 that connects to tube 19 is formed as a male connector. Lower limb 30 may be comprised of one or more of the same materials as base 6 or a material lighter in weight than base 6. In the embodiment of the mobile trainer sled shown in the FIGURES, lower limb 30 is an angled bar, cylinder or tube, which can be solid or hollow, as appropriate for the material of which it is comprised to provide lower end 30 with sufficient strength to support strike pad 48 in use, while preferably keeping the weight of the overall mobile trainer sled as light as possible. The exact angle is determined by the size of the mobile trainer sled overall and the size of the user for which it is intended. In one embodiment, for example, sized for a young high school age user, lower limb 30 extends outward from tube 19 about 18 inches to 20 inches at an angle of about 32 degrees to 34 degrees from the horizontal and then bends to extend further outward about 4 inches to 5 inches at an angle of about 10 to 12 degrees from the horizontal. Male end 31 of lower limb 30 connects with the female end of tube 19 and the male end 32 of lower limb 30 connects with female end 35 of spring section 36. A pins 72 such as a lock pin for example, or pin screw or screw pin 66 for another example, and/or clamp 78 can be used to further secure the connection.

Spring section 36 comprises a spring 38 between short tubes 35 and 37, in one embodiment each about 4 inches long, or generally in the range of about 3 inches to 5 inches in length, and about 4 inches to about 6 inches in diameter. Spring 38 has universal end holes for attachment to the short tubes 35 and 37. Spring 38 and spring section 36 provides energy absorption and vertical motion for the strike pad 48. The spring section 36 tension can have a variable scale of force absorption (since force used by a younger athlete is less than used by an older high school athlete which in turn is less than the force used by a professional athlete).

Tube 37 connects spring section 36 to male end 41 of extended or upper limb 42. A pin 72 can further secure the connection. Upper limb 42 is comprised of tubing, preferably solid tubing, in one embodiment, for example, about 14 to 16 inches in length where the tubing is about 4 to 5 inches in diameter. Referring to the FIGURES 16-21 showing an enlarged view of upper limb 42 effectively in rotation, the solid tubing upper limb 42 has an opening 81 at its front and back faces which in said embodiment example are approximately 14 inches long (measured from the top or end 43), approximately 1 inch wide (from the center of upper limb 42), and approximately 1 inch in depth. Also, there are zig-zagging openings or ridges 82 that connect to this opening 81 at the center of extended limb 42. These zigzagging openings or ridges 82 have a profile that in said embodiment example is approximately 4½ inches in one direction (toward the right), approximately 1 inch upwards, approximately 1½ inches in the opposing direction (toward the left), approximately 1 inch upwards, approximately 1½ inches again in the one direction (toward the right), approximately 1 inch upwards, approximately 2½ inches again in the opposing direction (toward the left), approximately 2 inches downwards, approximately 2 inches again in the opposing direction (toward the left), and approximately 1 inch downwards. Said profile is approximately 1 inch in depth and begins approximately 4 inches below end 43 of the upper limb 42. A similar profile occurs nearer end 41 of the upper limb 42, and in the embodiment example, this similar profile beings approximately 11 inches from end 43 of the upper limb 42. These two levels of zigzagging openings or ridges 82 enable adjustment—raising or lowering—of the strike pad 48 on the upper limb 42 to accommodate different height users. On the opposite side of upper limb 42 (not shown), these two zigzagging profiles are repeated, with the same dimensions as previously disclosed in the embodiment example, however opposite in direction. The zigzagging profile corresponds to an internal threading in the strike pad 48 which when together hold the strike pad 48 in place on the upper limb 42.

Figure 24:
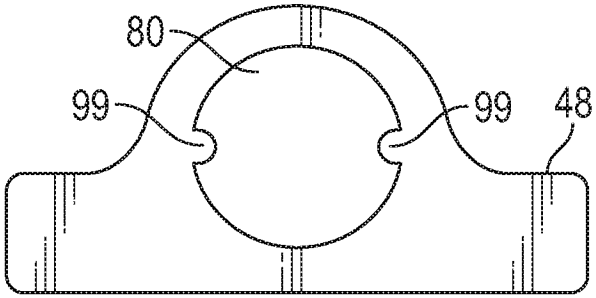
FIG. 24 is a bottom view of the strike pad of the mobile trainer sled showing the cavity for entry of the upper limb and its bumps or pegs for alignment with that upper limb.
Figure 23:
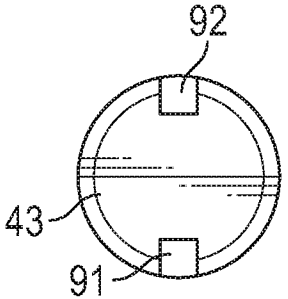
FIG. 23 is a top view of the alternative upper limb of the mobile trainer sled of FIGS. 22A, 22B, 22C, and 22D.

In an alternative embodiment of the invention, and particularly alternative external features of upper limb 42*a* for corresponding to internal features of strike pad 48 so as to "lock-on" strike pad 48 onto upper limb 42*a*, a simpler pattern or profile of ridges is used. Referring to FIGS. 22A, 22B, 22C, 22D, and 23, upper limb 42*a* has a simpler profile comprising two opposing vertical cuts or indentions or ridges 91 on "front" side and 92 on "back" side and three horizontal cuts or indentions or ridges 93, 94, and 95 on the "front" side and 96, 97, and 98 on the "back" side. When upper limb 42*a* is inserted into strike pad 48, pegs or bumps 99 in the interior cavity 80 of strike pad 48, as shown in FIG. 24, align with the vertical indentions 91 and 92 of upper limb 42*a* and then are directed to one of the horizontal indentions 93, 94 or 95 on one side and the corresponding horizontal indention 96, 97 or 98 on the opposing side. The particular level chosen is determined by the intended height of the strike pad for the height of the user.

Many other alternative variations of these interlocking or corresponding profiles could be used, and other means than internal interlocking or corresponding patterns between the upper limb 42 and the strike pad 48 could be used, to hold the strike pad 48 to upper limb 42, such as for example pins and/or clamps or other fasteners or connectors, with the goal being to hold with a minimum of effort but have the hold sufficient to withstand the forces the strike pad 48 will receive in use.

Figure 4:
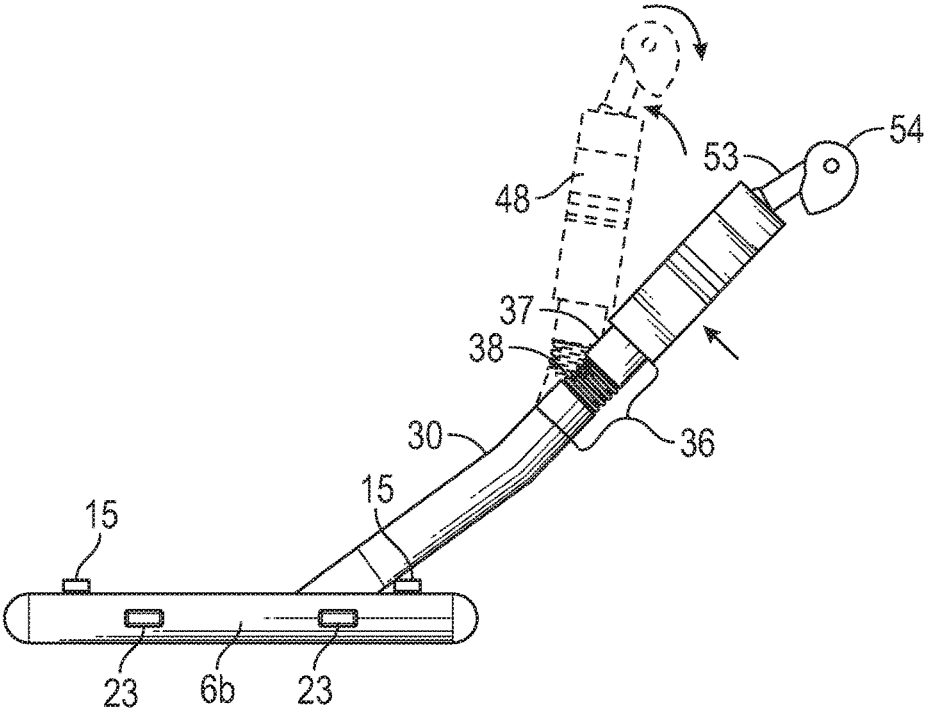
FIG. 4 shows a side view of the embodiment of the mobile trainer sled of FIG. 1B, illustrating the ability of the strike pad and head of the mobile trainer sled to move backwards and forwards through the action of the spring.
Figure 8A:
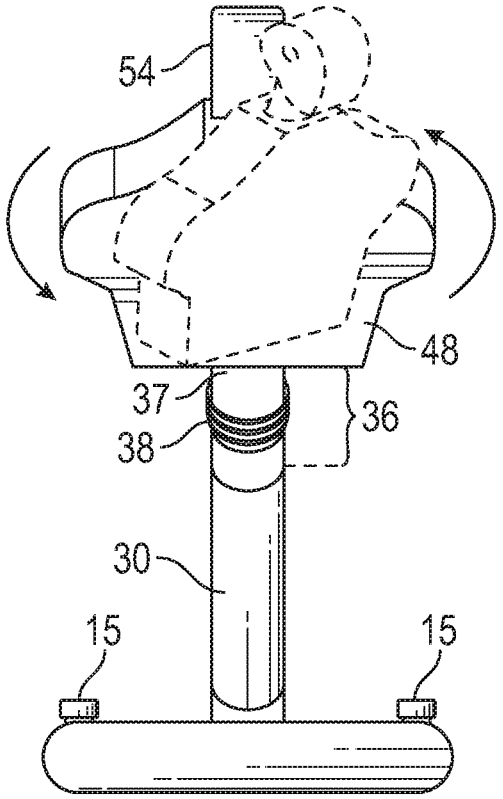
FIG. 8A and FIG. 8B show front views of the embodiment of the mobile trainer sled of FIG. 1A illustrating the ability of the strike pad of the mobile trainer sled to turn and/or twist at an angle both toward the left front and the right front of the sled, as shown respectively in FIG. 8A and FIG. 8B.
Figure 8B:
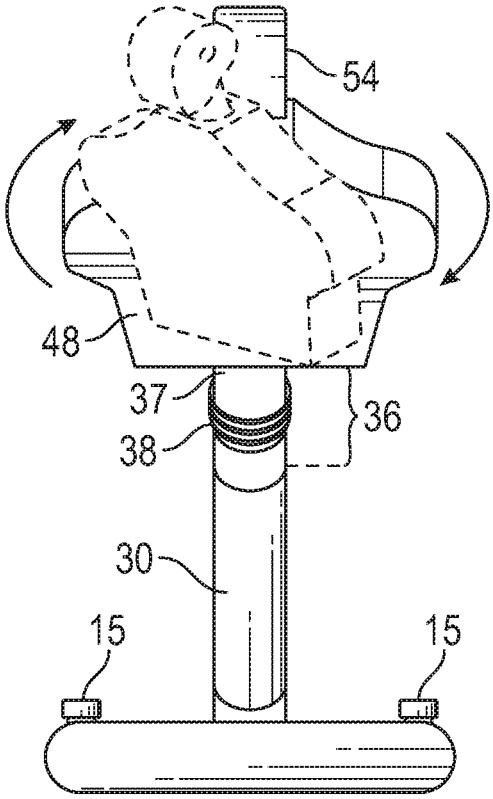
Figure 11:
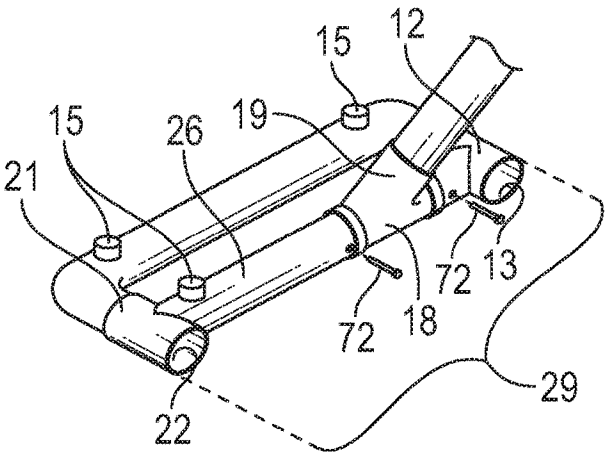
FIG. 11 is a top, rear perspective view of a portion of the base of the embodiment of the mobile trainer sled of FIG. 1C.
Figure 10:
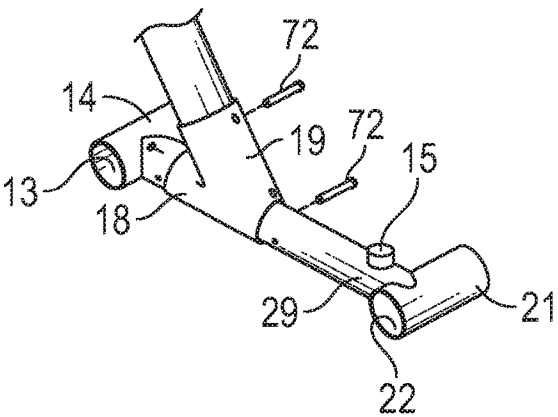
FIG. 10 is a side perspective view of the central connector of the base of the embodiment of the mobile trainer sled of FIG. 1E.
Figure 9:
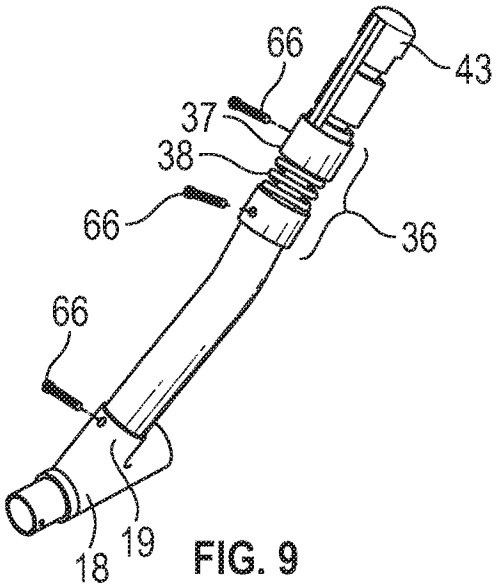
FIG. 9 is a side front perspective view of the lower limb, spring and upper limb sections of the embodiment of the mobile trainer sled of FIG. 1C.
Figure 13:
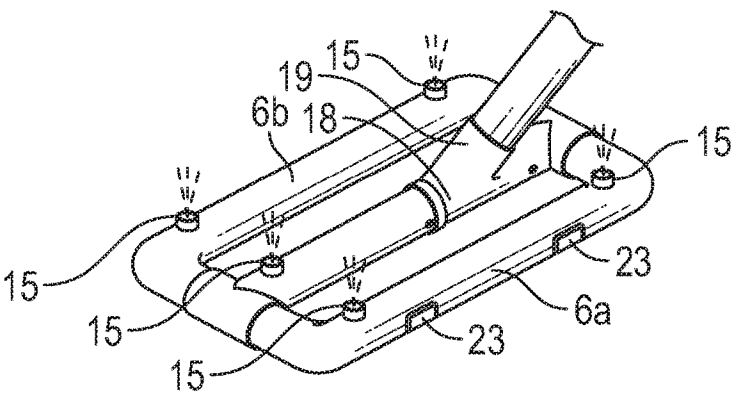
FIG. 13 is a top, rear perspective view of the base of the embodiment of the mobile trainer sled of FIG. 1C, as shown in FIG. 12, but with the caps closed on top of the base.
Figure 12:
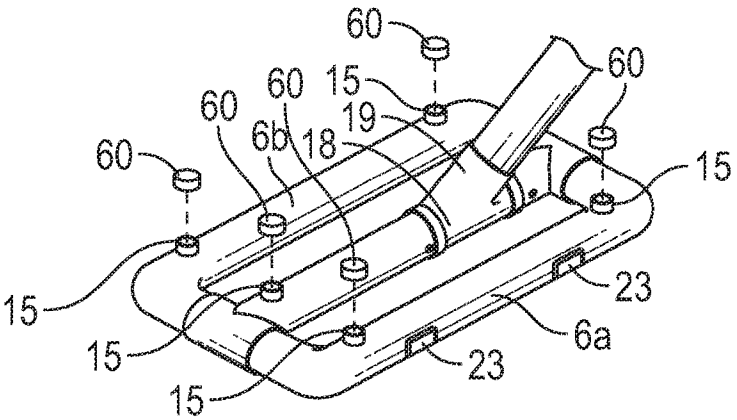
FIG. 12 is a top, rear perspective view of the base of the embodiment of the mobile trainer sled of FIG. 1C with caps lifted for filling the base with weighty material for adding weight to the base.

End 43 of upper limb 42 is introduced into a hollow central cavity 80 in strike pad 48 or strike pad 48*a* at hole 79 for receiving upper limb 42. Upper limb 42 supports strike pad 48, and the mechanism of upper limb 42 provided by the openings 81 and 82 in compatibility with the internal design of strike pad 48, and the mechanism of spring section 36, provide a range of motion to the strike pad 48, enabling it to turn in a left or right direction along a horizontal plane with respect to the main body of torso of strike pad 48 as shown in FIGS. 8A and 8B. Strike pad 48 can also tilt downward with movement downward of lower limb 30 (through tube 18 having the ability to pivot or tilt) as shown in FIG. 6 and can tilt back and forth as shown in FIG. 4. When the strike pad 48 is pushed in use, spring section 36 and particularly spring 38 absorbs energy from the pushing force ad provides at least some resistance to the push, encouraging the user to move his or her feet simulating pushing on a live individual.

Figure 14:
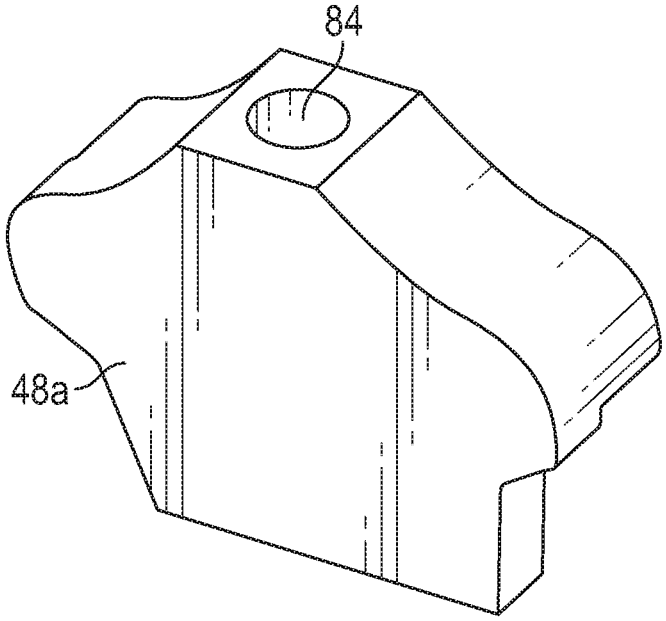
FIG. 14 is a front top perspective view of the strike pad of an alternative embodiment of the mobile trainer sled.
Figure 15:
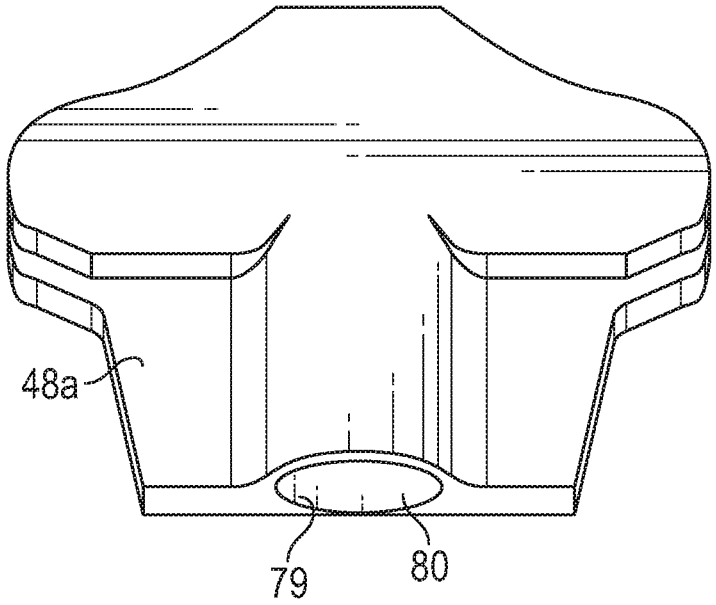
FIG. 15 is a back bottom perspective view of the strike pad of the alternative embodiment of the mobile trainer sled of FIG. 14.
Figure 16:
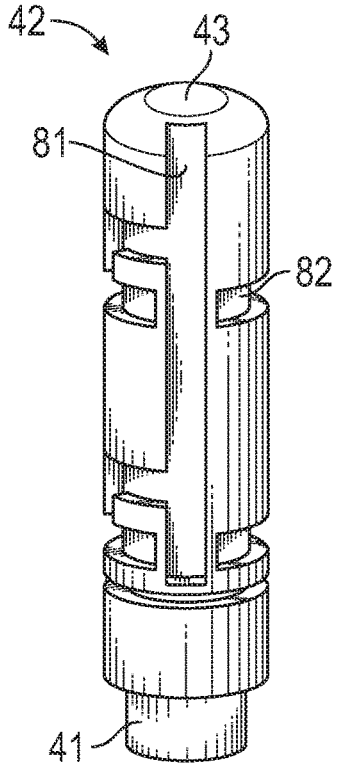
FIGS. 16-21 are enlarged views of the upper limb of the embodiment of the mobile trainer sled of FIG. 1C, showing the appearance of the limb on different sides, with FIG. 16 being at 0 degrees of rotation for demonstration, FIG. 17 being at approximately 60 degrees of rotation for demonstration, FIG. 18 being at approximately 90 degrees of rotation for demonstration.
Figure 17:
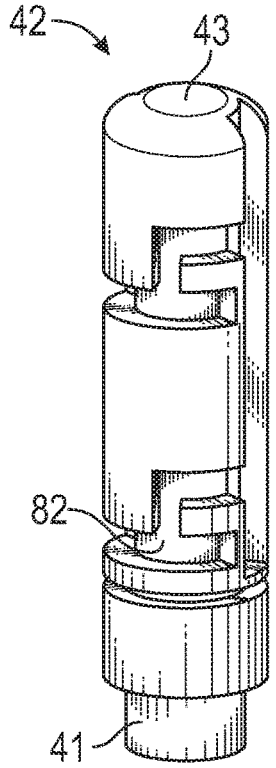
Figure 18:
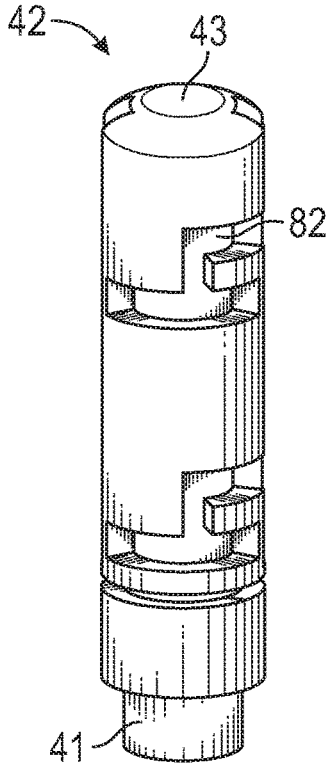
Figure 19:
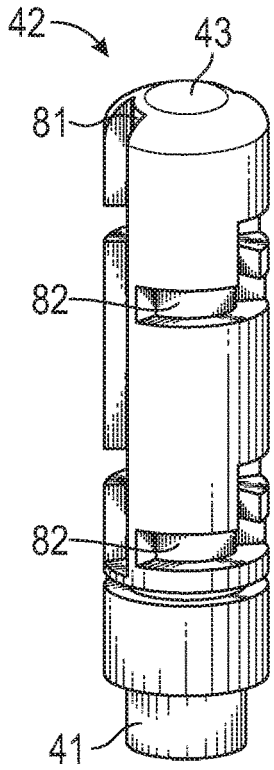
Figure 20:
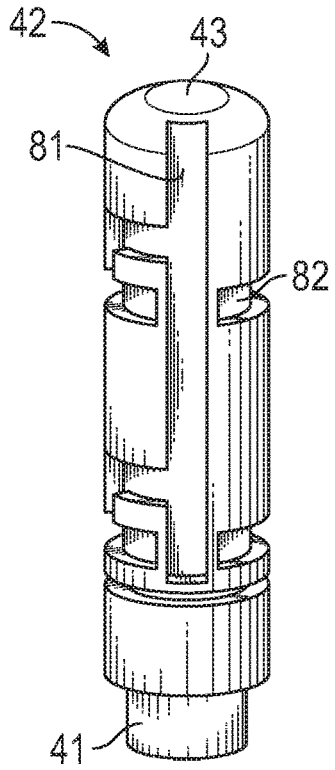
Figure 21:
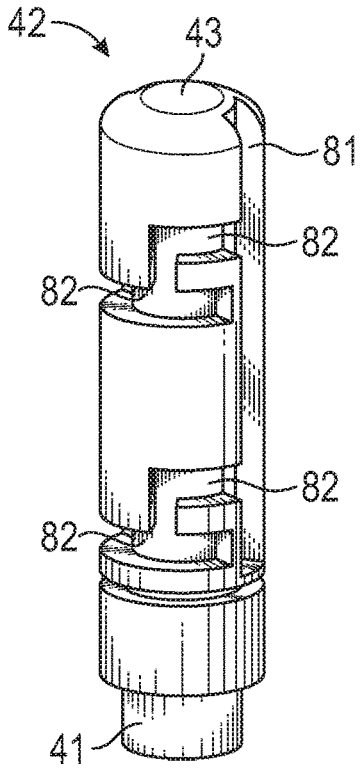
Figure 22D:
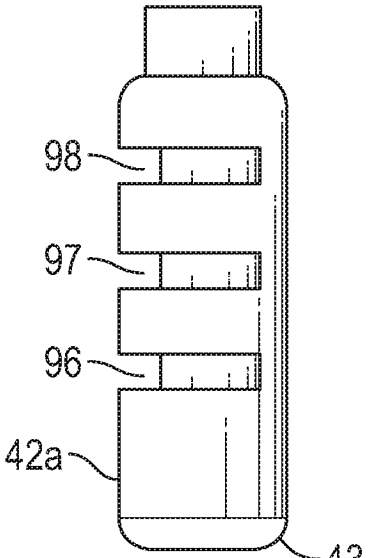
FIGS. 22A, 22B, 22C, and 22D are front, left side, back and right side of an alternative upper limb for supporting the strike pad of an alternative embodiment of the mobile trainer sled of the invention.
Figure 22C:
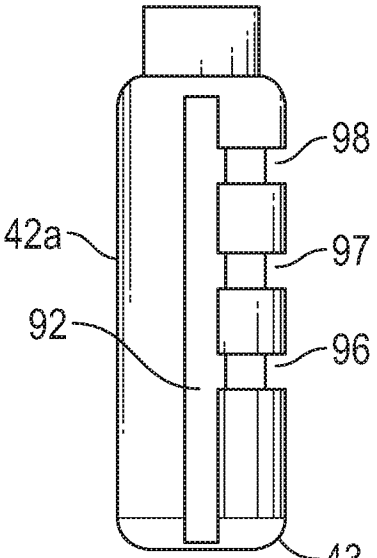
Figure 22B:
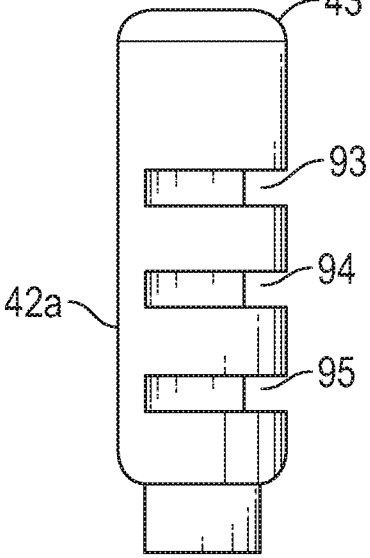
Figure 22A:
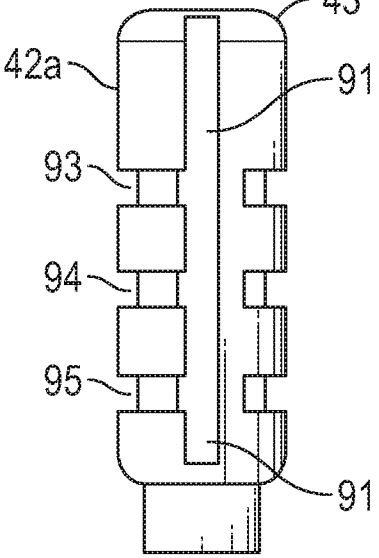

As shown in FIGS. 14 and 15, strike pad 48*a* can have the appearance or configuration of the upper body of a human, preferably above the navel or abdomen, or torso, or strike pad 48 can have generally flat surfaces as shown in the embodiment in FIGS. 1A-1E, 2, 3, 4, 5A, 5B, 5C, 6, 7, 8A, 8B. The strike pad 48 can be shielded with a cushion foam, rubber material or optionally shoulder padding material (e.g., for use in football).

Figure 5A:
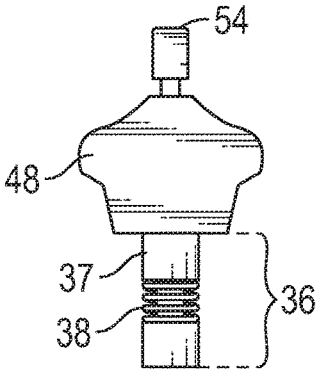
FIG. 5A shows the spring, strike pad, and head portion of the embodiment of the mobile trainer sled of FIG. 1A from a front view with the head in a resting position.
Figure 5B:
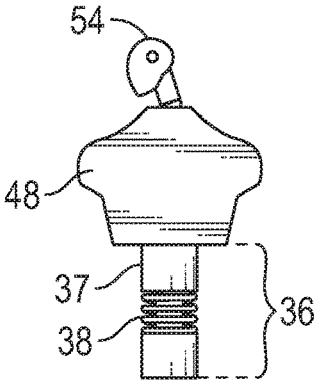
FIG. 5B shows the spring, strike pad, and head portion of the embodiment of the mobile trainer sled of FIG. 1A from a front view with the head turned or moved to the left.
Figure 5C:
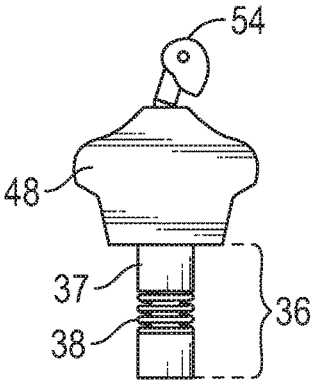
FIG. 5C shows the spring, strike pad, and head portion of the embodiment of the mobile trainer sled of FIG. 1A from a front view with the head turned or moved to the right.

Head 54 has a neck 53 and a rounded, ball type base 52 that is inserted into strike pad 48, or strike pad 48*a*, at hole 84 as shown in FIG. 14. In place in strike pad 48, the ball type base 52 has the effect of a ball-and-socket joint or junction so that the head 54 readily moves back and forth, and as shown in FIGS. 5B and 5C, from side to side, when the strike pad 48 is struck in use. Optionally, head 54 can be covered with a helmet (such as, for example, a football helmet) or padding.

Many different materials may be used to make the mobile trainer sled of the invention. The goal is to use materials that are light in weight but still strong enough to be useful for the purpose of the invention. It is contemplated that the entire mobile trainer sled of the invention can be comprised of various plastics and synthetic polymers—to name a few for nonlimiting example: ABS Plastic; Acetyl Resin (POM); Acrylic (PMMA); LCP Plastic; Nylon 6 (PA6); Nylon 6/6 (PA66); PBT Plastic; PC/ABS Plastic; PE-UJMW Plastic; PEEK Plastic; PET Plastic; Phenolic resin (PF); Polycarbonate (PC); Polyethylene, High density (PE-HD); Polyethylene, Low density (PE-LD); Polypropylene (PP); Polystyrene (PS); Polystyrene, High Impact (PS-HI); PPS Plastic; PVC-U (unplasticized, rigid); Urethane Plastic; SAN Plastic. One or more parts of the mobile trainer sled of the invention can alternatively be made of ferrous or nonferrous metals, such as for nonlimiting example: Cast iron, Ductile; Cast iron, gray; Cat iron, Malleable; Stainless Steel, Austenitic; Stainless Steel, Martensitic; Steel, Galvanized; Steel, High Strength low alloy (HSLA); Steel, Low alloy; Steel, Low carbon; Steel, Low carbon (heat treated); Aluminum alloy, Wrought. Various elastomers and natural and synthetic rubbers might alternatively be used, for example: Natural rubber (NR); Silicone rubber (SI); Neoprene Rubber; Buna-N Rubber; EPDM Rubber; Natural Gum Rubber; Viton Rubber; Natural Latex Rubber; SBR Rubber; styrene butadiene; Vinyl Rubber; Santoprene Rubber; ECH Rubber; Butyl Rubber; Latex-Free TPE Rubber; Hypalon Rubber; Synthetic Rubber. In still other embodiments, one or more parts of the mobile trainer sled of the invention can be comprised of wood, hardwood or softwood. Cushions and coverings for the strike pad and/or head 54 can be made of plastics and/or rubbers, but can alternatively be made of various foams, including without limitation: Polyester Fiberfill; Open Cell Foam; Closed Cell Foam; Compressed Polyester; Polyethylene Foam; Cross-linked Polyethylene Foam; Polyurethane Foam; Reticulated Polyurethane Foams; Polyester Foam; Polyether Foam; and Melamine Foam. Various fabrics might also or alternatively be used to cover the strike pad 48 and head 54, and particularly strong, tough fabrics such as for non-limiting example various forms of canvas It should be understood that the invention is not to be unduly limited to the foregoing which has been set forth for illustrative purposes. Various modifications and alternatives will be apparent to those skilled in the art without departing from the true scope and spirit of the present invention. While there has been, illustrated and described, particular embodiments of the present invention, it will be appreciated that numerous changes and modifications will occur to those skilled in the art, and it is intended to cover those changes and modifications which fall within the true spirit and scope of the present invention.

I claim:

1. A mobile trainer sled for teaching and practicing footwork, striking point, head placement and directional maneuvering techniques that minimize risk of concussion for contact sports, comprising:

a base capable of movement in any direction on a horizontal plane;

a strike pad capable of multi-planar, multi-directional movements, including forward, backward, twisting sideways, and near-collapsible sideways motions; and a support member having a spring therein and connecting the strike pad to the base with an optional pivot at the base that facilitates the near-collapsible sideways motion by the strike pad when struck;

wherein the strike pad and the base move when the strike pad is struck;

wherein the sled is portable, and wherein the base comprises:

a pair of elongated, cylindrical, 'U'-shaped hollow tubes for two opposing sides of the base;

a 'T'-shaped front tube that connects the two elongated, cylindrical, 'U'-shaped hollow tubes;

a 'T'-shaped back tube that connects the two elongated, cylindrical, 'U'-shaped hollow tubes; and a center tube that connects the 'T'-shaped front tube to the 'T'-shaped back tube and that has an up-angled, forward directed protrusion capable of receiving the support member.

2. The mobile trainer sled of claim 1 wherein the sled can be quickly and easily assembled for use and disassembled for transport by one person.

3. The mobile trainer sled of claim 1 wherein the support member is divided into an upper and lower limb by the spring and wherein the lower limb extends outwardly and upwardly from the base at an acute angle.

4. The mobile trainer sled of claim 3 wherein the upper limb has external indentions and the strike pad has an interior cavity and internal protrusions that correspond to and are compatible with the external indentions of the upper limb such that when the upper limb is inserted into the interior cavity of the strike pad the strike pad is held in place on the upper limb.

5. The mobile trainer sled of claim 4 wherein the height of the strike pad on the upper limb can be adjusted with choice of external indentions of the upper limb matched with or connected to internal protrusions of the strike pad.

6. The mobile trainer sled of claim 1 wherein the pivot at the base can be restrained with a pin.

7. The mobile trainer sled of claim 1 further comprising a head that connects to the top of the strike pad through a ball joint allowing free mobility of the head.

8. The mobile trainer sled of claim 7 wherein the strike pad has shoulder pads and the head of the mobile trainer has a helmet suitable for football practice.

9. The mobile trainer sled of claim 1 the height of the strike pad and the tension of the spring are adjustable to accommodate a range of user skill levels, sizes, and strengths.

10. The mobile trainer sled of claim 1 wherein the strike pad provides some resistance upon being struck and the sled pushes backwards after the spring absorbs some of the force from the striking, causing the user to adjust his footing accordingly.

11. The mobile trainer sled of claim 1 wherein the strike pad quickly returns to its resting position after movement following being struck.

12. The mobile trainer sled of claim 1 wherein the strike pad has multiple points for striking and handling, allowing the user to simultaneously practice footwork, striking point, head placement and directional maneuvering techniques that minimize risk of concussion for contact sports.

13. The mobile trainer sled of claim 1 wherein the pair of elongated, cylindrical, 'U'-shaped hollow tubes are fillable with sand, water or other weighty material.

14. The mobile trainer sled of claim 13 wherein each of the 'U'-shaped tubes has at least one hole and cap for filling said 'U'-shaped tubes with weighty material and for removing said material from said 'U'-shaped tubes.

15. The mobile trainer sled of claim 1 wherein the center tube is capable of pivoting sideways or either or both sides up to about 90 degrees from vertical.

16. The mobile trainer sled of claim 15 further comprising a pin, screw, or clamp that can restrain the pivoting of the center tube.

* * * * *